US007398944B2

(12) United States Patent
Lewis et al.

(10) Patent No.: US 7,398,944 B2
(45) Date of Patent: Jul. 15, 2008

(54) HANDS-FREE ELECTRONIC TOWEL DISPENSER

(75) Inventors: Richard P. Lewis, Marietta, GA (US); Paul F. Tramontina, Alpharetta, GA (US); Geoffrey M. Engelstein, Bridgewater, NJ (US); Robert C. Oliver, Allentown, PA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 292 days.

(21) Appl. No.: 11/001,564

(22) Filed: Dec. 1, 2004

(65) Prior Publication Data

US 2006/0169827 A1 Aug. 3, 2006

(51) Int. Cl.
*B65H 43/00* (2006.01)

(52) U.S. Cl. ..... 242/563; 250/221

(58) Field of Classification Search ..... 242/563, 242/563.2; 250/221

See application file for complete search history.

(56) References Cited

U.S. PATENT DOCUMENTS

| | | | | |
|---|---|---|---|---|
| 4,611,768 | A | | 9/1986 | Voss et al. |
| 4,666,099 | A | | 5/1987 | Hoffman et al. |
| 4,721,265 | A | | 1/1988 | Hawkins |
| 4,738,176 | A | | 4/1988 | Cassia |
| 4,765,555 | A | | 8/1988 | Gambino |
| 4,767,131 | A | | 8/1988 | Springer et al. |
| 4,786,005 | A | | 11/1988 | Hoffman et al. |
| 4,790,490 | A | | 12/1988 | Chakravorty |
| 4,796,825 | A | * | 1/1989 | Hawkins ..... 242/564 |
| 4,817,483 | A | | 4/1989 | Armbruster |
| 4,826,262 | A | | 5/1989 | Hartman et al. |
| 4,960,248 | A | | 10/1990 | Bauer et al. |
| 5,107,734 | A | | 4/1992 | Armbruster |
| 5,131,302 | A | | 7/1992 | Watanabe |
| 5,205,454 | A | | 4/1993 | Schutz et al. |
| 5,452,832 | A | | 9/1995 | Niada |
| 5,604,992 | A | | 2/1997 | Robinson |
| 5,772,291 | A | | 6/1998 | Byrd et al. |
| 6,069,354 | A | | 5/2000 | Alfano et al. |
| 6,105,898 | A | | 8/2000 | Byrd et al. |
| 6,250,530 | B1 | | 6/2001 | LaCount et al. |
| 6,293,486 | B1 | | 9/2001 | Byrd et al. |
| 6,321,963 | B1 | | 11/2001 | Gracyalny et al. |
| 6,354,533 | B1 | | 3/2002 | Jespersen |

(Continued)

OTHER PUBLICATIONS

EPO Search Report, Dec. 6, 2005.

*Primary Examiner*—William A Rivera
(74) *Attorney, Agent, or Firm*—Dority & Manning, P.A.

(57) ABSTRACT

A hands-free towel dispenser for dispensing a measured sheet from a roll of towel material includes a housing having an internal volume so as to retain at least one roll of towel material therein. An electronically powered dispensing mechanism is contained within the housing for dispensing a measured sheet from the roll of towel material upon actuation of the dispensing mechanism. A sensor is contained within the housing to detect an object placed within a detection zone of the sensor. Control circuitry is configured with the sensor and dispensing mechanism to initiate a dispense cycle upon detection of an object by the sensor. The sensor is disposed relative to the housing such that the detection zone is defined substantially below a bottom surface of the housing requiring that an object must be placed at a location below the housing to be detected by the sensor.

15 Claims, 13 Drawing Sheets

U.S. PATENT DOCUMENTS

| | | | | |
|---|---|---|---|---|
| 6,412,655 | B1 | 7/2002 | Stuetzel et al. | |
| 6,412,679 | B2 | 7/2002 | Formon et al. | |
| 6,419,136 | B2 | 7/2002 | Formon et al. | |
| 6,592,067 | B2 | 7/2003 | Denen et al. | |
| 6,648,267 | B2 | 11/2003 | Stanland et al. | |
| 6,685,074 | B2 | 2/2004 | Gracyalny et al. | |
| 6,695,246 | B1 | 2/2004 | Elliott et al. | |
| 6,710,606 | B2 | 3/2004 | Morris | |
| 6,736,348 | B1 | 5/2004 | Formon et al. | |
| 6,742,689 | B2 | 6/2004 | Formon et al. | |
| 6,745,927 | B2 | 6/2004 | Formon et al. | |
| 6,766,977 | B2 | 7/2004 | Denen et al. | |
| 6,793,170 | B2 | 9/2004 | Denen et al. | |
| 6,826,985 | B2 | 12/2004 | Broehl | |
| 6,830,210 | B2 * | 12/2004 | Formon et al. | 242/563 |
| 6,838,887 | B2 | 1/2005 | Denen et al. | |
| 6,854,684 | B2 | 2/2005 | Byrd et al. | |
| 6,860,447 | B2 | 3/2005 | Boone et al. | |
| 6,871,815 | B2 | 3/2005 | Moody et al. | |
| 6,977,588 | B2 * | 12/2005 | Schotz et al. | 340/562 |
| 2002/0050544 | A1 | 5/2002 | Stanland et al. | |
| 2002/0109034 | A1 | 8/2002 | Moody et al. | |
| 2002/0109035 | A1 | 8/2002 | Denen et al. | |
| 2003/0167893 | A1 | 9/2003 | Morris et al. | |
| 2003/0168489 | A1 | 9/2003 | Formon et al. | |
| 2003/0168549 | A1 | 9/2003 | Formon et al. | |
| 2003/0168550 | A1 | 9/2003 | Formon et al. | |
| 2004/0035976 | A1 | 2/2004 | Byrd et al. | |
| 2004/0041057 | A1 | 3/2004 | Byrd et al. | |
| 2004/0129825 | A1 | 7/2004 | Andersson | |
| 2004/0134924 | A1 | 7/2004 | Hansen et al. | |
| 2004/0135027 | A1 | 7/2004 | Elliott et al. | |
| 2004/0160234 | A1 | 8/2004 | Denen et al. | |
| 2004/0178297 | A1 | 9/2004 | Moody et al. | |
| 2004/0251375 | A1 | 12/2004 | Denen et al. | |
| 2005/0011987 | A1 | 1/2005 | Lemaire et al. | |
| 2005/0051005 | A1 | 3/2005 | Broehl | |
| 2005/0072874 | A1 | 4/2005 | Denen et al. | |
| 2005/0077419 | A1 | 4/2005 | Thomas et al. | |
| 2005/0171634 | A1 | 8/2005 | York et al. | |

* cited by examiner

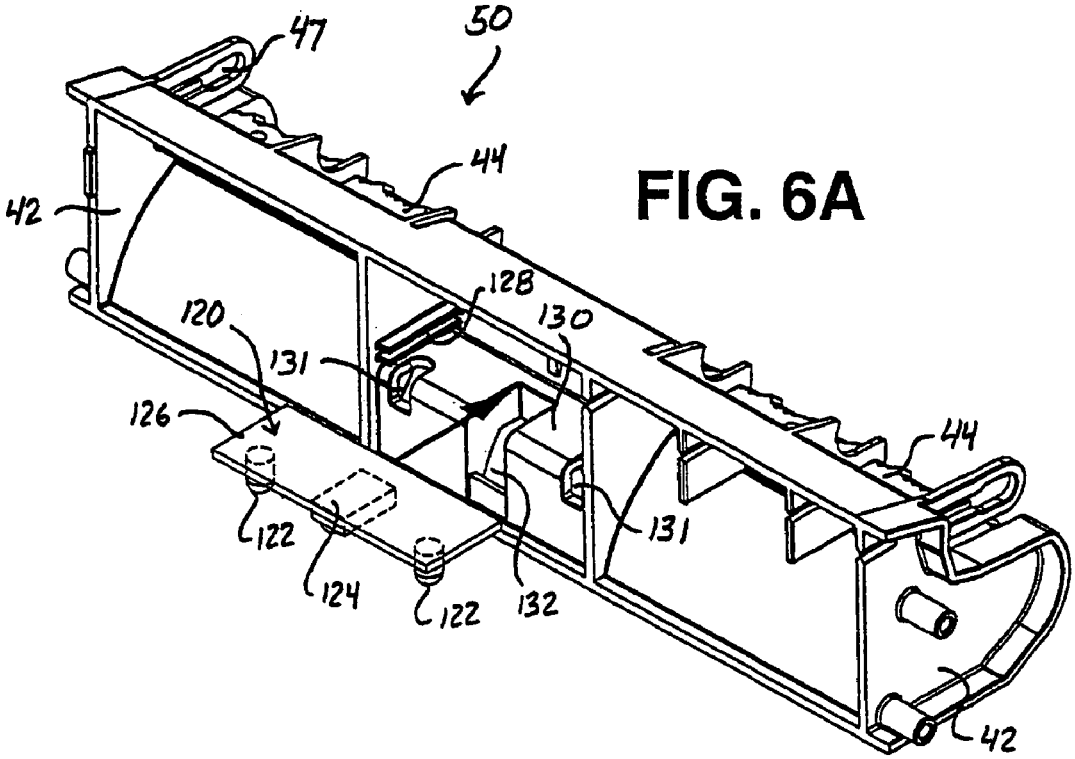
FIG. 6A
FIG. 6B
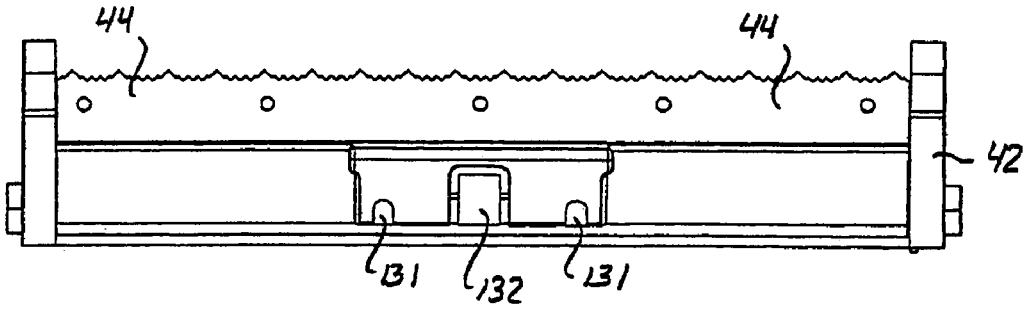
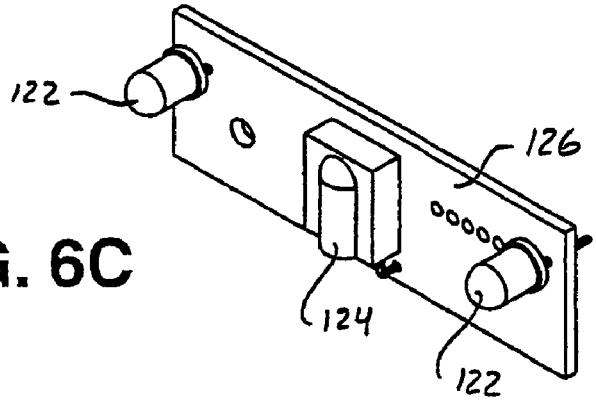
FIG. 6C

HANDS-FREE ELECTRONIC TOWEL DISPENSER

FIELD OF THE INVENTION

The present invention relates generally to the field of dispensers for dispensing lengths of towel material from a roll, and more particularly to "hands-free" electronic dispensers that automatically dispense a measured length of towel material upon sensing a user.

BACKGROUND OF THE INVENTION

Electronic towel dispensers are well know in the art, including dispensers that automatically dispense a metered length of towel material upon sensing the presence of a user. This type of dispenser has become known in the art as a "hands-free" dispenser in that it is not necessary for the user to manually actuate or otherwise handle the dispenser to initiate a dispense cycle. The control systems and mechanical aspects of conventional hands-free dispensers are wide and varied.

For example, U.S. Pat. No. 5,772,291 describes an electronic hands-free towel dispenser powered by an array of photovoltaic cells. The dispenser utilizes a photo sensor to detect the presence of a user through the front cover of the housing; the photo sensor and associated control circuitry activate a motor to dispense a predetermined length of towel upon detecting the user. The photo sensor reacts to changes in a room's ambient light intensity, and when a person places an obtrusion, such as their hand, within a predetermined distance (detection range) of the front of the dispenser, the amount of ambient light reaching the photo sensor is decreased sufficiently to cause the photo sensor and control circuitry to register a "detect" and initiate a dispense cycle.

U.S. Pat. No. 6,419,136 describes an electronic dispenser for dispensing individual towel segments from a continuous roll of paper having spaced perforation or tear lines. By using perforated web material, the individual sheets can be separated from the roll by a user grasping a length of the material that extends out of the housing and tearing the sheet along a perforation line. A cutting mechanism is not necessary and energy is conserved because the motor only rotates a feed roller. The control circuitry includes a proximity sensor coupled with a microprocessor to activate the drive motor when the user's hand is detected. The proximity sensor is disposed to "look" through the front cover of the dispenser housing.

U.S. Pat. No. 6,412,655 describes an AC powered towel dispenser that utilizes a capacitive sensor on the front of the dispenser housing. The sensor includes electrodes disposed behind a sensor field in the cover that may cover the entire width of the housing. The electrodes establish a dielectric having a defined capacitance in the idle state. If there is a change in the dielectric caused by a user placing their hand in front of the dispenser housing, a change in the capacitance results and triggers a dispensing sequence.

U.S. Pat. No. 5,452,832 describes an automatic paper towel dispenser wherein a photocell detector actuates an on-off switch for supplying power to a drive motor for a specified time period to dispense a length of paper towel. The photocell is disposed on the side of the dispenser housing.

The art is thus constantly seeking ways to improve upon conventional hands-free towel dispensers. The present invention relates to such an improvement.

OBJECTS AND SUMMARY OF THE INVENTION

Objects and advantages of the invention will be set forth in part in the following description, or may be obvious from the description, or may be learned through practice of the invention.

An electronic hands-free towel dispenser is provided for automatically dispensing a measured sheet of towel (web) material upon detection of an object placed within a defined detection zone. The dispenser may be battery powered, AC powered (with an appropriate transformer and adapter), or capable of being switched between battery power and AC power. The dispenser includes a housing having an internal volume so as to retain at least one roll of towel material therein. In a particular embodiment, the housing is configured to retain a primary reserve roll and a depleted stub roll. The housing may take on any desirable and aesthetically pleasing configuration, and may include a back member and removable cover member. The cover member may be hinged relative to the back member to provide access to the interior volume and components of the dispenser.

The dispenser includes a an electronically powered dispensing mechanism contained within the housing for automatically dispensing the measured sheet from the roll of towel material upon a valid detection of an object in the detection zone. Numerous configurations of electrically driven dispensing mechanisms are known in the art and may be configured for use with the present dispenser. In a particular embodiment, a separate chassis or module is received in the housing, the module having the dispensing mechanism mounted therein. The mechanism may include a drive roller and associated components, a pressure roll assembly, and a tear bar. The pressure roll assembly includes a pressure roll biased by springs against the drive roller, the towel material passing between the pressure roll and drive roller. An opening for the towel material is defined in the module and aligns with a dispensing opening in the housing.

In an embodiment wherein the dispenser dispenses from a stub roll and subsequently from a reserve or "main" roll, the chassis may include main roll holders and stub roll holders for rotatably supporting the respective rolls in a position within the module for unobstructed dispensing therefrom. An automatic transfer mechanism is provided to transfer dispensed towel material from the stub roll to the main roll when the stub roll is nearly fully depleted.

A roll-size gauge may be configured in the module to indicate to service or maintenance personnel when the main roll has been depleted a sufficient amount to be moved to the stub roll position. This gauge may be a member that is biased against the outer circumferential surface of the main roll such that it tracks with the decreasing diameter of the main roll as the web material is depleted. When the main roll reaches a certain depleted diameter, the gauge may activate a switch causing an LED to light, or other indicator, to indicate that the main roll is depleted and should be replaced. Alternatively, the indicator may be a mechanical type, such as a flag that becomes visible upon the diameter of the main roll being sufficiently reduced.

The dispensing mechanism dispenses a measured length or sheet of the web material, which may be accomplished by various means, such as a timing circuit that stops the drive roller after a predetermined time. In a particular embodiment, a revolution counter is provided that measures the degree of rotation of the drive roller and is interfaced with control circuitry to stop a drive roller motor after a defined number of revolutions of the roller. This counter may be an optical encoder type of device, or a mechanical device. The control circuitry may include a device to allow maintenance personnel to adjust the sheet length by increasing or decreasing the revolution counter set point.

The drive mechanism may include a drive motor and gear assembly mounted in the module, the gear assembly transmitting motive force from the motor to the drive roller. The web material passes through the nip defined by the drive roller and pressure roller such that rotation of the drive roller causes the material to be advanced out through the dispensing throat of the housing. A tear bar is disposed in the throat so that a user can separate a sheet of the material by grasping and pulling the sheet across the tear bar. In an alternative embodiment, an automatic cutting device may be provided to automatically cut the sheet of material.

A sensor is provided to detect an object placed in the detection zone below the bottom surface of the dispenser. This sensor may be a passive sensor that detects changes in ambient conditions, such as ambient light, capacitance changes caused by an object in a detection zone, and so forth. In an alternate embodiment, the sensor is an active device and includes an active transmitter and associated receiver, such as one or more IR transmitters and IR receiver. The transmitter transmits an active signal in a transmission cone corresponding to the detection zone, and the receiver detects a threshold amount of the active signal reflected from an object placed into the detection zone. Control circuitry is configured with the sensor for initiating a dispense cycle upon a valid detection signal from the receiver.

The sensor is disposed relative to the housing such that the detection zone is defined substantially below a bottom surface of the housing, and an object must be purposefully placed at a location below the housing to be detected. In this manner, the dispenser is not inadvertently triggered by an object passing in front of the dispenser, such as a person passing or standing in front of the dispenser in a public restroom. In the embodiment of an active transmitter, the transmitter may be disposed at an angle such that a sensing axis of the transmission cone is angled towards the back of said housing. For example, the transmitter (and respective receiver) may be disposed in the dispensing throat so as to "look" under and towards the back of the housing. In one embodiment, the sensing axis may be at an angle of about 15 degrees with respect to vertical towards the back of the housing, and the transmitter may have a transmission cone of about 40 degrees or less (20 degrees on each side of the sensing axis). The transmitter may be positioned such that, even at a maximum sensitivity setting, the effective transmission cone of the active signal does not extend in a forward direction beyond a vertical plane of a forward most portion of the housing. A portion of the transmission cone may be shielded by structure in the dispensing throat to further limit the forward most sensing point of the detection zone.

It may be desirable that the detection zone (i.e., range) of the sensors be adjustable. In this regard an adjustment switch may be provided whereby maintenance personnel can adjust detection zone by varying the sensitivity of the transmitter and receiver, for example by varying power to the transmitter or adjusting the threshold of the receiver.

It may also be desirable to provide the dispenser with a device to prevent a subsequent dispensing cycle if a sheet of the web material has been dispensed but not removed. A separate "hanging sheet" detector may be provided and integrated with the control circuitry for this purpose. However, in one configuration according to the invention, the detection sensor may be configured to also serve this purpose and, thus, reduce the cost and complexity of the dispenser and control circuitry. For example, the sensor may include the active transmitter discussed above oriented at a position within the dispensing throat such that if a sheet of material is left hanging out of the throat, the sheet essentially blocks transmission of the active signal into the detection zone. The web material itself does not adequately reflect the signal to the receiver to generate a valid detection signal. Thus, objects placed into the detection zone will not cause a subsequent dispensing cycle until the hanging sheet has been remove.

It may also be desired to provide the dispenser with an ambient light detector integrated with the control circuitry to prevent a dispensing cycle unless a threshold amount of ambient light is detected in an area where the dispenser is located. For example, if the dispenser is located in a public facility, it may be desired to power down the control circuitry when the facility is closed and darkened. The ambient light detector is disposed in the housing such that it is essentially shielded from normal and expected "frontal" changes in ambient light conditions in a public facility. For example, in a particular embodiment, the detector is mounted on a side of a circuit housing and looks out through an opening in the side of the dispenser cover. In this way, persons or objects placed relatively close to the front of the dispenser will not cause the dispenser to inadvertently shut down. A bypass switch may be provided so that maintenance personnel can disable the ambient light detection feature. This may be necessary in operating environments of the dispenser wherein varying conditions of ambient light are present.

As mentioned, one or a plurality of operating parameters of the dispenser may be adjusted, and manual input switches may be provided for this purpose. An indicator may also be provided so that maintenance personnel can easily determine which parameter has been adjusted and by how much. In a particular embodiment, the indicator may be one or more lights, such as LED lights, wherein a characteristic of the light, such as color or pattern, is used to indicate different adjustment settings.

The invention will be described in greater detail below by reference to particular embodiments illustrated in the drawings.

BRIEF DESCRIPTION OF THE DRAWINGS

FIGS. 6A through 6B are perspective views of the throat assembly particularly illustrating the sensor transmitters and receiver housed within the throat sensor;

FIG. 6C is a perspective view of a sensor board configuration incorporated within the throat assembly in accordance with one embodiment;

DETAILED DESCRIPTION

Figure 1:
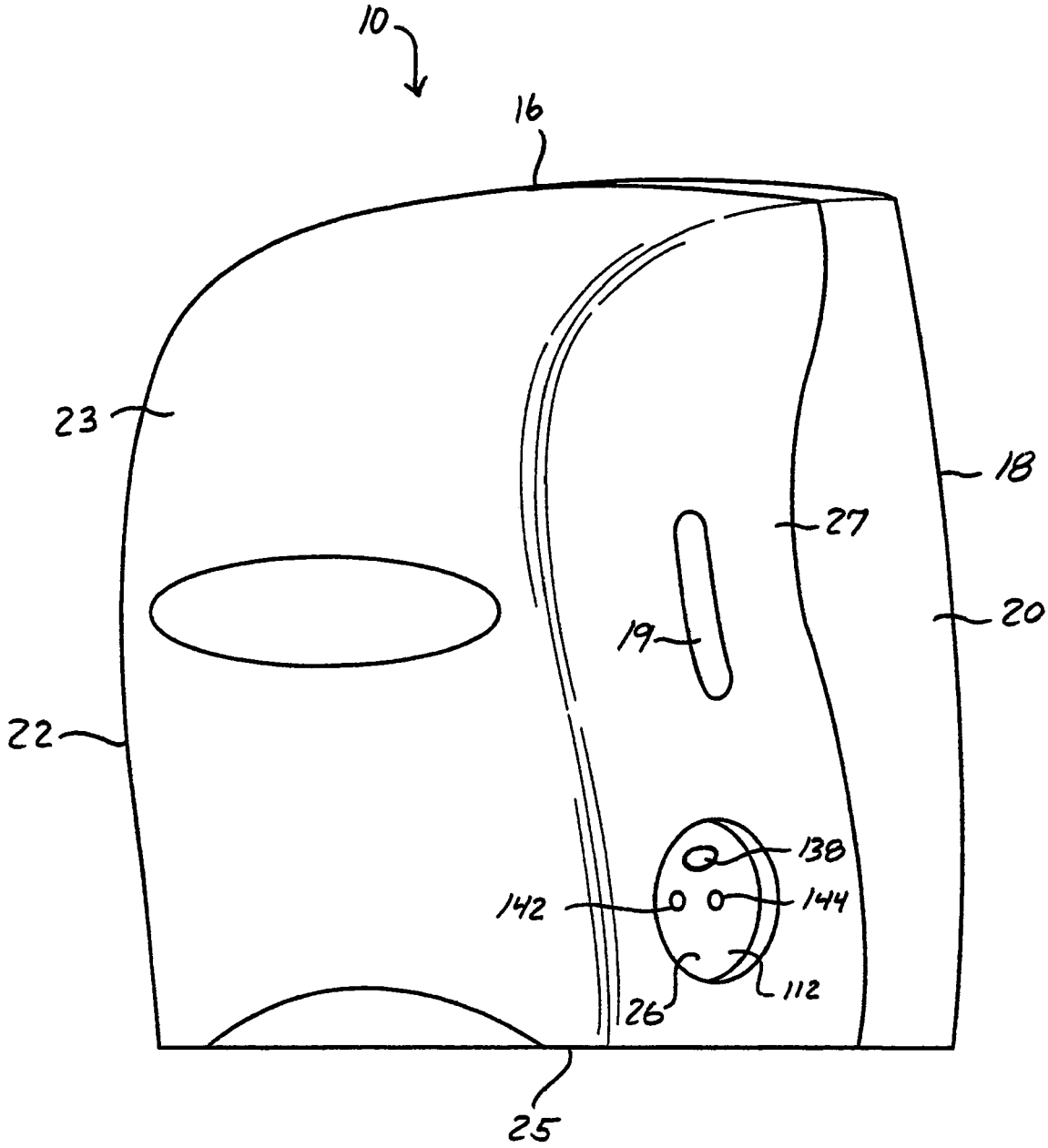
FIG. 1 is a perspective view of an embodiment of a hands-free electronic dispenser according to the invention.

Reference will now be made in detail to embodiments of the invention, one or more examples of which are illustrated in the drawings. Each example is provided by way of explanation of the invention, and not meant as a limitation of the invention. For example, features illustrated or described as part of one embodiment, may be used with another embodiment, to yield still a further embodiment. It is intended that the present invention include modifications and variations to the embodiments described herein.

Figure 7:
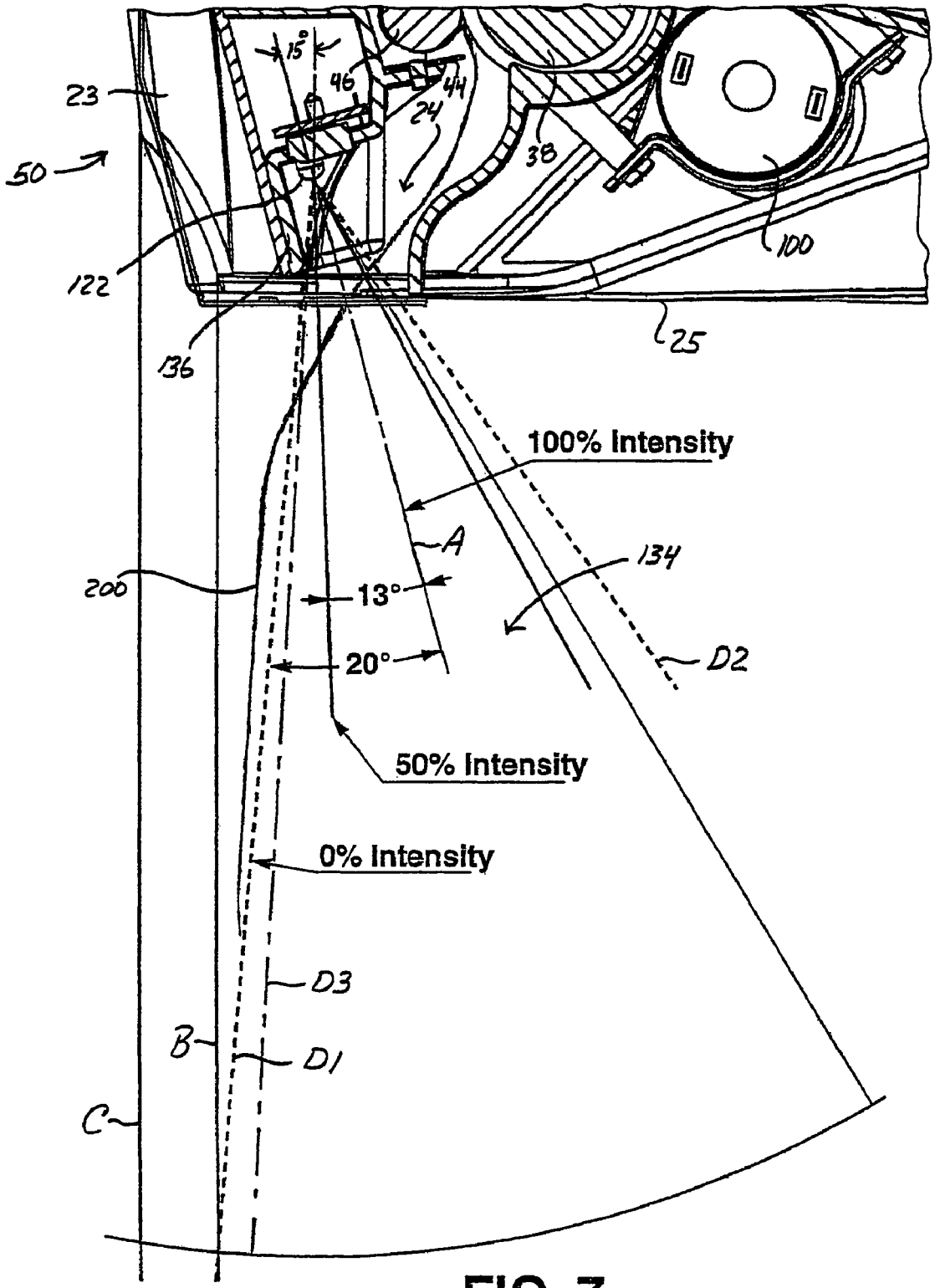
FIG. 7 is a diagrammatic view illustrating aspects of the detection zone under the dispenser.

Referring particularly to FIGS. 1 through 4, an embodiment of a dispenser 10 according to the invention is illustrated. The dispenser 10 includes a housing 16 of any desired shape and configuration. The housing 16 includes a base 18 with side walls 20 and a cover 22 pivotally mounted on the base 18 so as to be movable from the closed position illustrated in FIG. 1 to the open position illustrated in FIG. 2. The cover 22 includes a front wall 23 and side walls 27 that align with the side walls 20 of the base 18 to define an interior volume for housing the operational components of the dispenser 10, as well as the rolls of web material to be dispensed, including a main roll 12 and a stub roll 14. A window 19 may be provided in one or both of the cover side walls 27 so that a maintenance technician may readily visually determine the remaining amount of web material of the main roll 12. The right-hand (when facing the dispenser 10) side wall 27 includes an opening 26 through which an indicator plate 112 is visible to maintenance personnel without having to open the cover 22. The opening 26 may be fitted with a clear lens (not shown) to prevent access to the module 28 while allowing external viewing of the indicator plate 112. The indicator plate 112 will be described in greater detail below. Any conventional locking mechanism 21 (FIG. 2) may be provided to secure the cover 22 to the base 18. The housing 16 includes a bottom underside portion 25 from which the material is dispensed. Referring to FIG. 7, a dispensing opening is provided in a throat 24 from the housing 16 at the terminal portion of a dispensing path 48, as described in greater detail below.

It should be appreciated that the dispenser 10 is not limited to any particular style or configuration, or combination of components that combine to form the dispenser.

Figure 2:
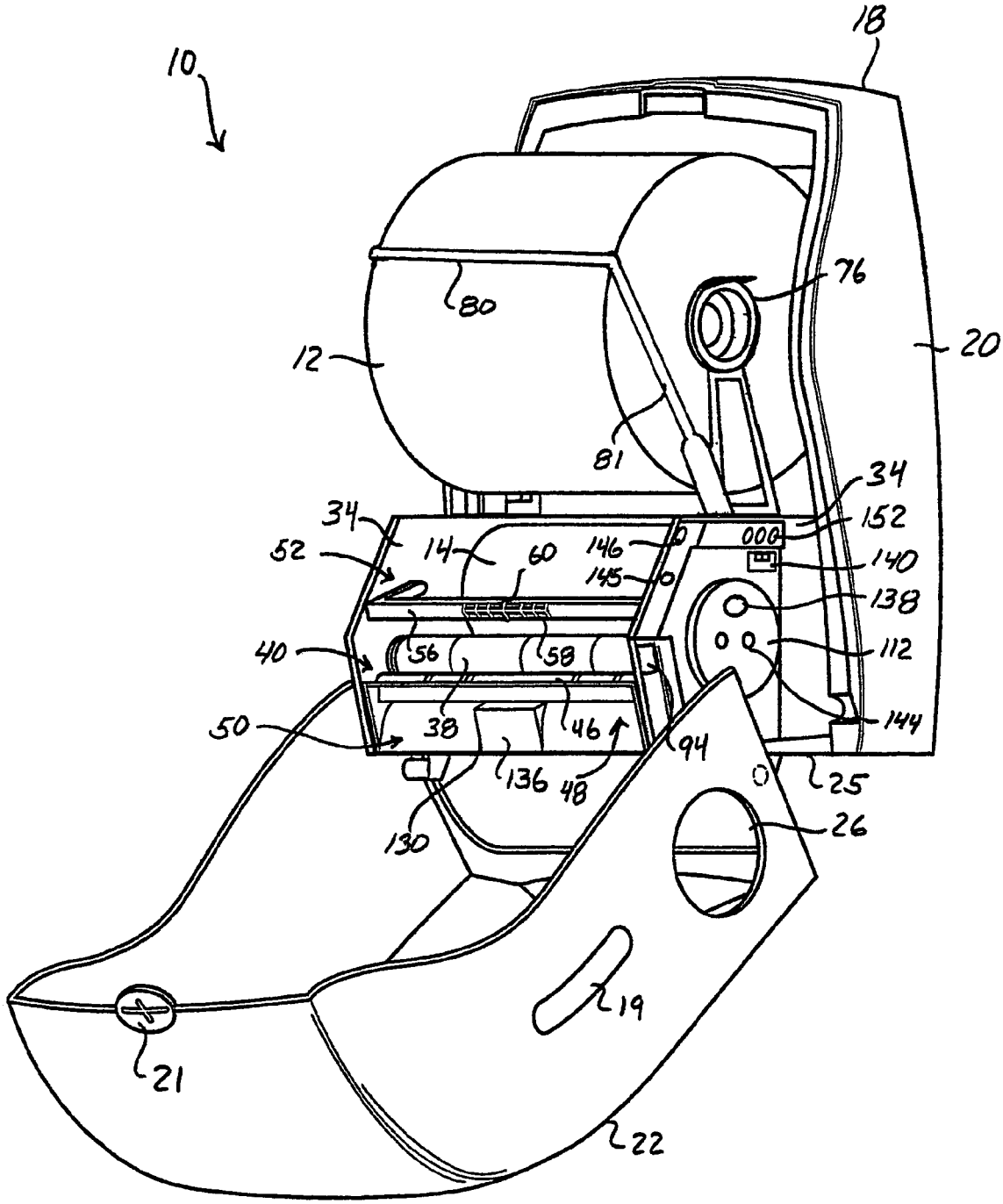
FIG. 2 is a perspective view of the dispenser of FIG. 1 with the front cover in its open position.
Figure 3:
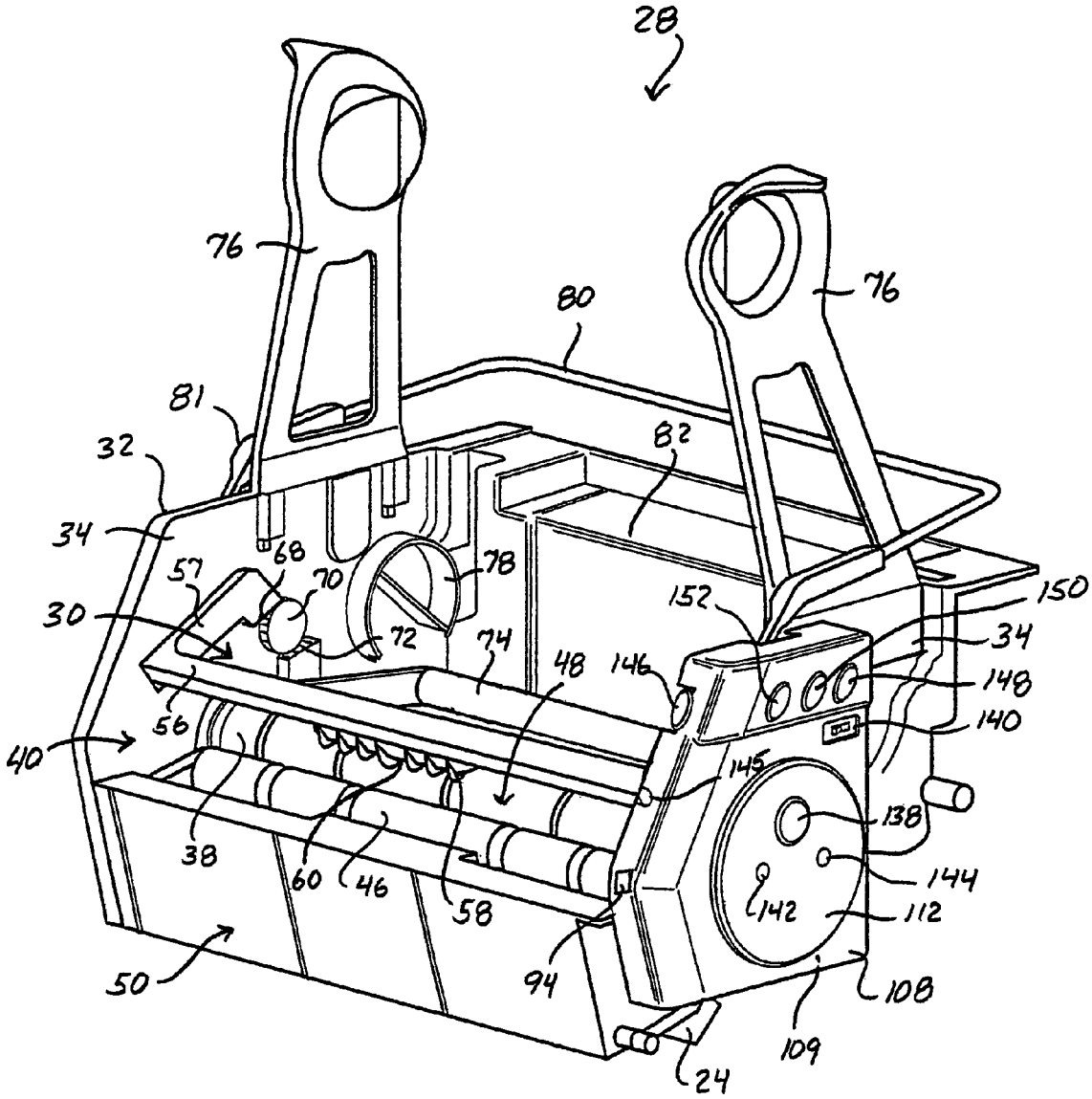
FIG. 3 is a perspective view of the module unit removed from the dispenser of FIG. 1.

The operational components of the dispenser 10 may be mounted directly onto the base 18 within the interior volume of the housing 16. In a desirable embodiment illustrated in the figures, a dispensing module 28 is received in the housing 16, as seen in FIGS. 1 and 2, and the operational components are mounted within the module 28. The module 28 may be readily removable from the base 18 for servicing and/or replacing components without the necessity of having the remove the entire dispenser 10 from its support surface (i.e., wall). The housing 16 may be considered as a shell into which the module 28 of FIG. 3 is inserted and removed. The module 28 includes a frame or chassis 32 having left and right side plates 34. Within the module 28 between the side plates 34 are mounted the components of the dispensing mechanism 30, including a pressure roller assembly 40, a transfer mechanism 52, a throat assembly 50, and a drive motor and gear assembly 98 (FIG. 4), as described in greater detail below.

Figure 4:
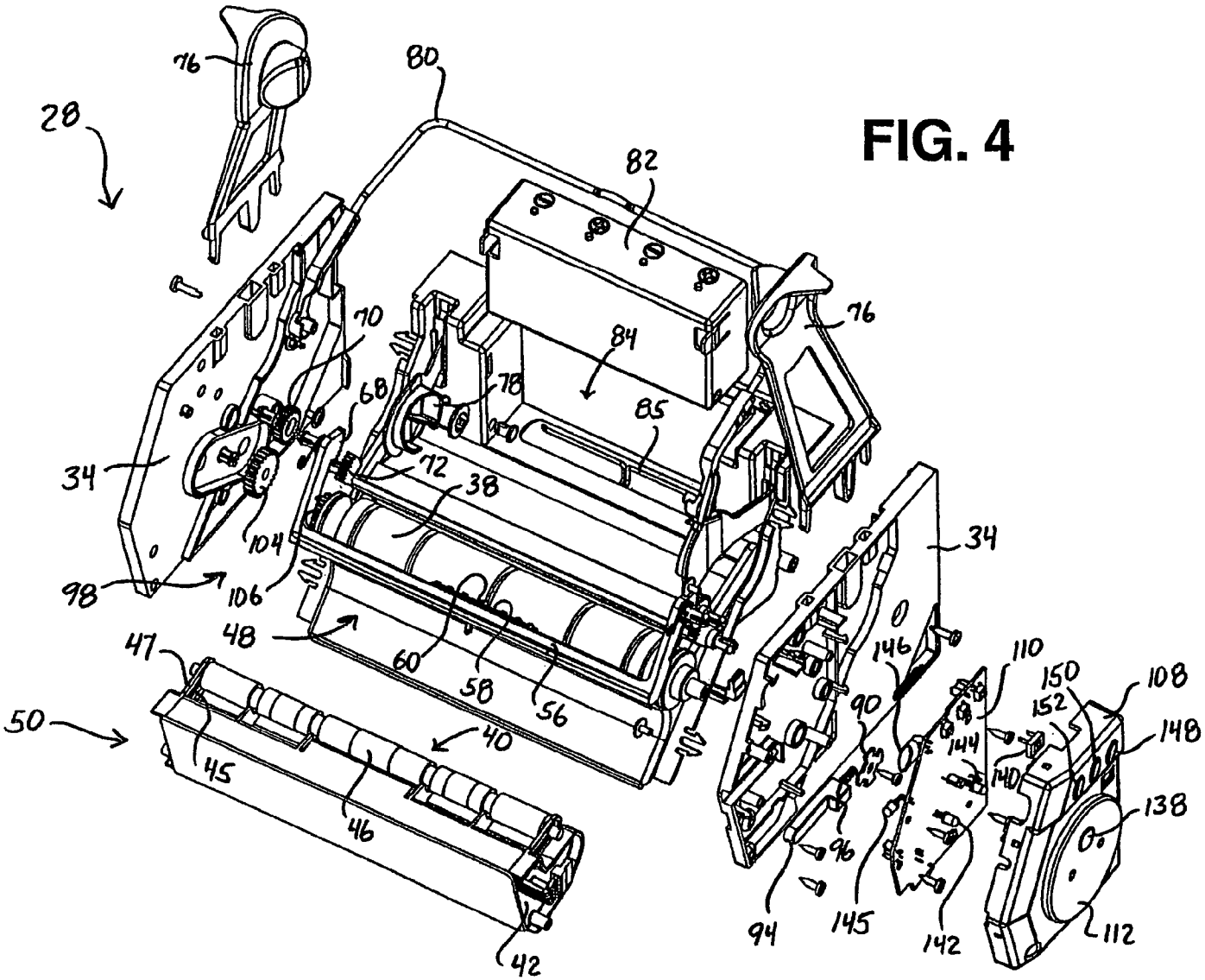
FIG. 4 is a component assembly view of an embodiment of module unit that may be utilized in a dispenser according to the invention'

Left and right main roll holders 76 are attached to the module side plates 34, as seen in FIG. 4, and hold the main roll 12 of sheet material. Stub roll holders 78 are provided for rotatably supporting the stub roll 14 in the position within the module below and rearward of the main roll 12.

Referring particularly to FIGS. 3 through 6B, the pressure roller assembly 40 may be housed in a throat assembly 50 that is, in turn, mounted within the module 28. The throat assembly 50 includes a frame 42 that may be fixed in position within the module, or pivotally mounted to the module 28 to facilitate loading of new rolls of web material. The assembly 40 is held in a closed position by way of a detent or other suitable locking device. The throat assembly 50 includes a cutter bar 44 attached to the frame 42, as particularly shown in FIG. 6B. The cutter bar 44 is disposed along the dispensing path 48 upstream of the dispensing opening 24 and downstream of the nip between a drive roller 38 and pressure roller 46, as illustrated in FIG. 7. To separate a sheet 200 of the web material that has been dispensed from the dispenser 10, a user grasps the sheet 200 hanging from beneath the housing 16 and pulls the sheet forward against the cutter bar 44 such that the sheet tears and separates along the line defined by the cutter bar.

The pressure roller 46 has end axles that reside in slots 47, as seen in FIGS. 4 and 6A. Springs 45 within the slots 47 bias the pressure roller 46 against the drive roller 38 such that the web material passing between the nip of the rollers is advanced along the dispensing path 48 upon rotation of the drive roller 38. The throat assembly 50 defines a portion of the dispensing path and the forward portion of the dispensing throat 24, as seen in FIG. 7.

The module 28 includes an automatic transfer mechanism 52 to transfer dispensing of the web material from the stub roll 14 to a main roll 12 when the web material on the stub roll 14 is nearly fully depleted. From an operational standpoint, this transfer mechanism 52 operates substantially as described in U.S. Pat. No. 6,079,305 issued on Jun. 27, 2000, and the '305 patent is incorporated herein in its entirety for all purposes. Referring particularly to FIGS. 3 and 4, the transfer mechanism 52 includes a transfer bar 56 with arms 57 pivotally mounted to the module side plates 34. A gear 68 is provided on the ends of the arms 57, as particularly seen in FIGS. 3 and 4. The transfer bar 56 includes a "roller" section that may be defined by a central curved ribbed section 58. The section 58 includes a securing mechanism, such as a barb 60. The leading end of the web material from the main roll 12 passes over the roller section 58 and is held by the barb 60 while material is feed from the stub roll 14. Idler transfer gears 70 are rotatably mounted to the module side plates 34 and are engaged by the gears 68 on the ends of the transfer bar arms 57. A stub roll sensing bar 74 is pivotally mounted to the module side plates 34 below stub roll holders 78, and is biased towards the axis of the stub roll holders 78 so as to track the decreasing diameter of the stub roll as it is depleted. The stub roll sensing bar 74 is configured with gears 72 that rotate upon pivotal movement of the sensing bar 74, the gears 72 being engaged with the idler gears 70.

As the stub roll is depleted, motion of the sensing bar 74 is transferred to the transfer bar 56 via the gears 68, 70, and 72. At a certain decreased diameter of the stub roll 14, the transfer bar 56 rotates to a position such that the leading end of the web material held by the securing mechanism 60 is brought by the roller section 58 into contact with the web material being dispensed from the stub roll causing the leading edge of the material from the main roll to be pulled from the barb 60 and conveyed with the material from the stub roll between the nip of the drive roller 38 and pressure roller 46. The "new" web material from the main roll 12 is dispensed simultaneously with the stub roll material until the stub roll is completely depleted. If no stub roll is present in the dispenser, the transfer bar 56 and roller section 58 contact against the web material dispensed from the main roll 12.

A "fuel gauge" bar 80 is pivotally affixed to the side plates 34 by way of arms 81 and is spring biased towards the center of the main roll 12 such that it tracks with the decreasing diameter of the main roll 12 as the web material is depleted. When the main roll 12 reaches a diameter suitable for moving the roll to the stub roll position, a pawl (not visible) on the end of one of the arms 81 causes a switch in the control circuitry to close and activate an LED 142 on the indicator plate 112 (visible through the opening 26 in the side of the cover). In this way, maintenance personnel are alerted that the main roll 12 is depleted and should be replaced.

The drive motor and gear assembly 98 includes components mounted in the module 28. An electrically powered drive motor 100 is contained in a space under and behind the drive roller 38, as seen in FIG. 7. The motor includes a drive shaft and a drive gear attached thereto (not visible in the figures). The drive gear extends towards the left-hand side plate 34 of the module 28 and engages with an idler drive gear 104 mounted on the side plate 34 (seen in FIG. 4). The idler gear 104 is engaged with a drive roller gear 106 mounted on the end of the drive roller 38. Thus, upon energizing the motor 100, the drive roller 38 is caused to rotate by way of shaft drive gear, idler gear 104 and drive roller gear 106. Rotation of the drive roller results in conveyance of the web material disposed in the nip between the pressure roller 46 and drive roller 38 along the conveying path 48 and out of the dispensing throat 24.

The dispensing mechanism 30 may be powered by batteries contained in battery compartment 82 that is received in a battery well 84 rearward of the stub roll holders 76 (see FIGS. 3 and 4). Any suitable battery storage device may be used for this purpose. A conductor 85 is disposed below the battery well 84 and mates with contacts on the underside of the battery compartment 82 for delivering power from the batteries to the circuit board 110 and motor 100. Alternatively, or in addition to battery power, the dispenser may also be powered by a building's AC distribution system. For this purpose, a plug-in modular transformer/adapter may be provided with the dispenser, which connects to a terminal or power jack port located in the bottom edge of the circuit housing 108 (indicated in FIG. 3) for delivering power to the control circuitry and associated components. The control circuitry may include a mechanical or electrical switch that isolates the battery circuit upon connecting the AC adapter in order to protect and preserve the batteries.

Figure 5:
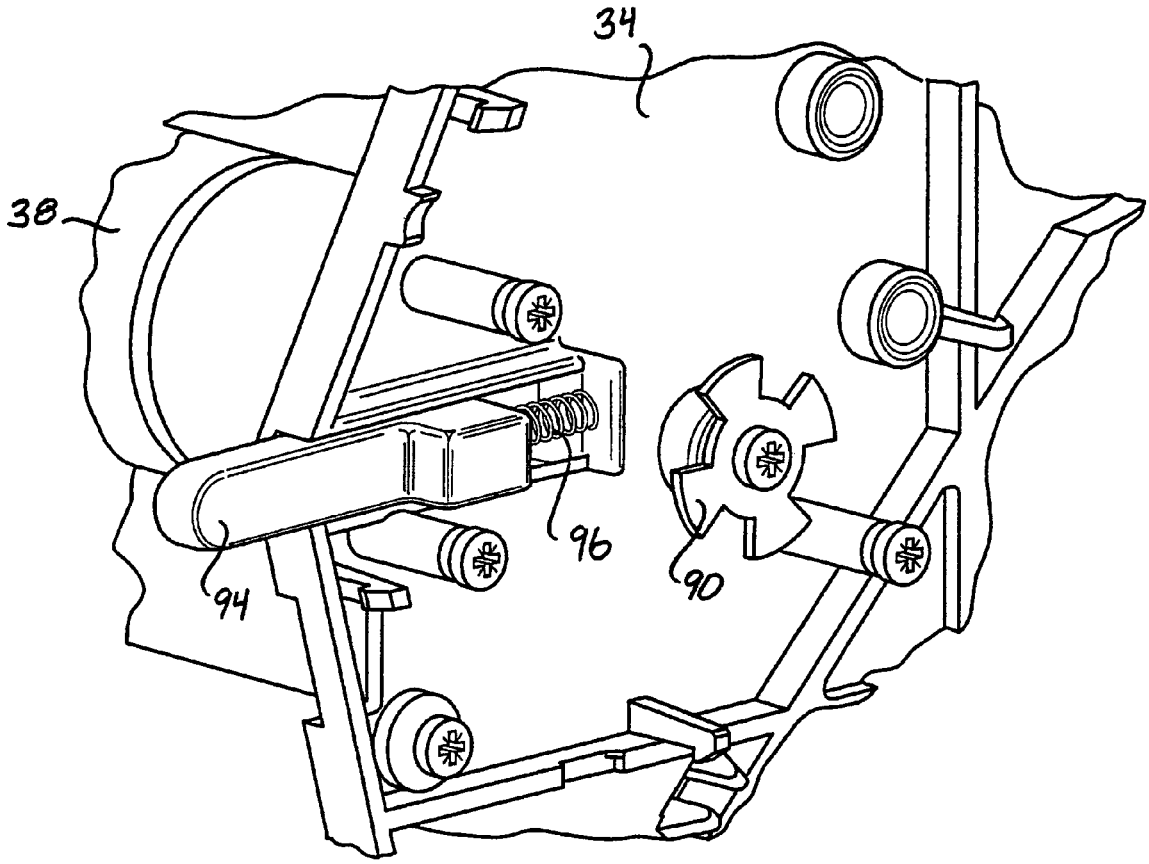
FIG. 5 is a side perspective view of a portion of the module particularly illustrating the housing cover sensor and drive roller reflector wheel component of the driver roller rotations sensor.

A revolution counter mechanism is provided to control the length of web material dispensed. Any number of optical or mechanical devices may be used in this regard. In the illustrated embodiment, an optical encoder is used to count the revolutions of the drive roller 38, and this count is used by the control circuitry to meter the desired length of the sheet to be dispensed. Referring to FIGS. 4 and 5 in particular, an optical reflective wheel 90 is provided on the end axle of the drive roller 38. The wheel 90 extends beyond the side plate 34 of the module 28 and includes a plurality of reflective tabs that rotate upon turning of the drive roller 38. An optical sensor 92, such as a photo cell, (illustrated schematically in FIG. 9) is mounted on the facing side of the circuit board 110 and detects light pulses generated from the reflective tabs of the wheel 90 as the drive roller 38 rotates, the number of pulses being indicative of the length of sheet material being conveyed through the dispensing mechanism 30 based on the known diameter of the drive roller 38. For example, a drive roller 38 with a diameter of 1.5 inches has a linear circumference of 4.71 inches, and each of the tabs (if four tabs are used) indicates a quarter revolution equal to 1.78 linear inches. If a sheet length of approximately 12 inches is desired, the drive roller 38 is rotated for ten pulses, or two and one-half revolutions, for a sheet length of 11.78 inches.

It may be desired that the control circuitry disable or prevent the dispenser from operating if the front cover 22 is open, for example if the dispenser is being serviced or reloaded. Any manner of mechanical or optical position sensors and switches may be used for this purpose. FIGS. 4 and 5 illustrate a spring loaded mechanical sensor that may be used. The sensor includes a projection 94 biased outward beyond the forward edge of the module side plate 34 by a spring 96. If the cover 22 is in its open position, the projection 94 is extended as shown in FIG. 5 and a corresponding lock-out switch in the control circuitry is opened and disables operation of the dispensing mechanism 30. When the cover 22 is closed, the projection 94 is pushed in by engagement with the cover 22 and the switch is closed to allow a dispense sequence. It should be appreciated that a vast number and configuration of detectors and associated circuitry may be used to accomplish this function.

The control circuitry components are mounted on the circuit board 110 contained in a circuit housing 108 mounted on the right side plate 34 of the module 28. The circuitry will be discussed in greater detail below. As seen for example in FIGS. 2-4, an array of adjustment push buttons 148, 150, and 152 are mounted on the circuit board 110 and are accessible externally of the circuit housing 108. These push buttons mate with respective switches on the circuit board and are used to control adjustment of various parameters, such as sheet length, delay time between dispense cycles, and sensitivity of the activation sensor.

An additional push button 146 is provided on the forward edge of the circuit housing 108 and functions as a manual paper feed option. The dispensing mechanism 30 will operate and dispense material as long as the button 146 is depressed.

The push buttons 148, 150, and 152 are associated with one or more LEDs, such as LED 142 on the circuit housing 108, the LED 142 being visible through the opening 26 in the cover side wall 27. Each of the buttons 148, 150, and 152 has three settings for its respective function: short, medium, and long, and the LED 142 is used to indicate the respective setting. Any combination of light characteristics may be used as an indication. For example, the LED may be multi-colored and different colors are used to indicate the respective settings. Alternately, the LEDs may have a distinctive flash pattern to indicate different settings. Any number of indications may be used in this regard.

Also contained in the circuit housing 108 and visible through opening 26 in the cover side wall 27 is a low battery LED indicator 144. The LED 144 is activated when the battery voltage decreases to a predetermined value. A clear lens may be provided over the LEDs to protect the devices.

In operation for initially dispensing material from main roll 12, the cover 22 is pivoted forward away from the base 18. This causes the cover sensor 94 to activate a control switch resulting in deactivation of the control circuitry to prevent accidental activation of the mechanism during the loading process. In an embodiment wherein the pressure roller assembly 40 is pivotally mounted to the module 28, the assembly 40 is unlatched and pivoted forward to provide an easy load opening for the web material from the main roll 12. The leading edge of the material from the main roll 12 is then placed over the drive roller 38, and the pressure roller assembly 40 is closed and latched in its detent position. The material is thus held in the nip between the pressure roller 46 and drive roller 38. In an embodiment wherein the pressure roller assembly 40 is fixedly mounted relative to the module 28, the leading edge of the material from the main roll 12 is simply threaded into the nip between the drive roller 38 and the pressure roller 46. Once the cover 22 is closed, the cover sensor 94 causes the associated control switch to close and the circuit will be activated.

When the dispensing mechanism 30 is activated (as described below), the drive roller 38 is driven by the motor 100 and respective gear assembly (shaft gear, and gears 104 and 106) to convey the web material between the pressure roller 46 and drive roller 38 along the dispensing path 48 and out the dispensing throat 24. Without a stub roll present, the roller section 58 are also in contact with the sheet material as it is dispensed.

Once the main roll 12 has reached a stub roll size as determined by the fuel gauge bar 80 and associated LED 142, it may be moved to the stub roll holders 78 while the leading edge of the web material remains between the pressure roller 46 and drive roller 38. The stub roll is placed above and against the biased sensing bar 74. The leading edge of the material from the new main roll 12 is then passed under the transfer bar 56 and roller section 58 and secured by the barb 60.

As the stub roll 14 depleted, the sensing bar 74 pivots and, via gears 72, 70, and 68, causes the transfer mechanism 52 to pivot and bring the transfer bar 56 closer to the drive roller 38. When the stub roll material is nearly depleted, the leading edge of the new main roll 12 is brought by the roller section 58 of the transfer bar 56 into contact with the sheet material being dispensed from the stub roll 14 causing the leading edge of the material to be pulled from the barb 60 and conveyed with the material from the stub roll 14 between the pressure roller 46 and drive roller 38. The "new" web material from the main roll 12 will be dispensed simultaneously with the stub roll material until the stub roll 14 is completely depleted.

The dispenser 10 includes a sensor to detect an object placed in a detection zone 134 (FIG. 7) below the bottom surface 25 of the dispenser. As discussed, this sensor may be an active or passive sensor. Upon detection of an object within the detection zone 134, the control circuitry initiates a dispense cycle. In the illustrated embodiment, the sensor is an active infrared (IR) sensor that utilizes active transmitters 122 to emit an IR beam into the detection zone 134, and a receiver 124 to detect IR light reflected from an object in the detection zone 134. If the amount of reflected light is sufficient (above a detection threshold value), the circuitry controller initiates a dispense cycle wherein the motor 100 drives the drive roller 38 until the predetermined number of pulses are detected by the optical encoder (drive roller revolution counter) indicating that the correct length of material has been dispensed. The user then grasps the dispensed sheet and pulls it forward to tear the sheet against the cutter bar 44.

Figure 8:
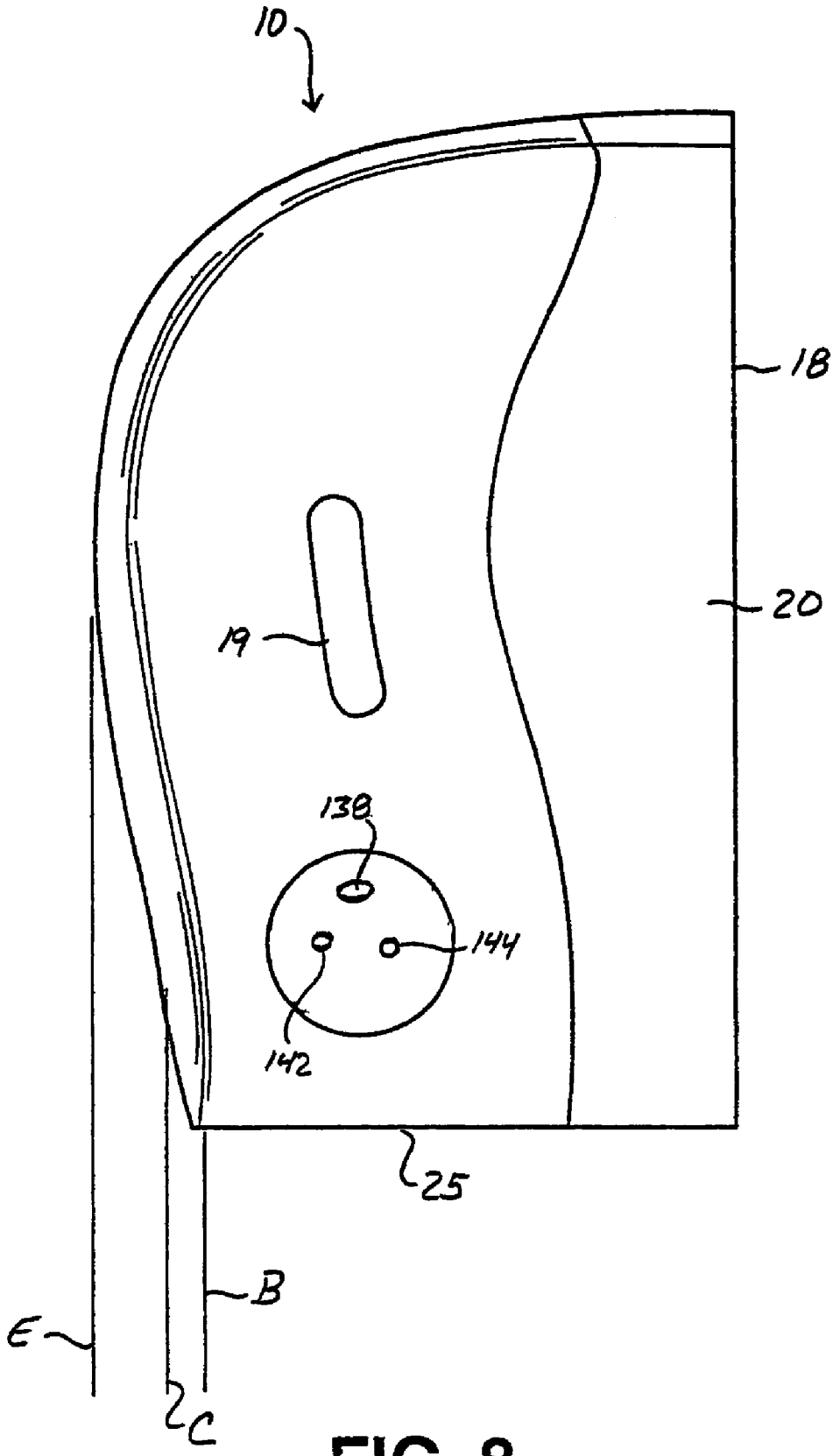
FIG. 8 is a side perspective view of the dispenser of FIG. 1 particularly illustrating the planes of certain components of the front portion of the dispenser.

Referring particularly to FIGS. 6 through 8, the active IR transmitters 122 and receiver 124 are mounted on a sensor board 126. The board 126 is inserted into board slots 128 defined within a board housing 130 on the middle underside of the throat assembly 50, as particularly seen in FIGS. 6A and 6B. Openings 131 are defined in the housing 130 through which the transmitters 122 actively transmit. An opening 132 is provided in the housing 130 for the receiver 124. The transmitters 122 and receiver 124 are in electrical communication with the circuit board 110, and the transmitters 122 continuously transmit at a pulse rate that is dictated by the control circuitry, particularly by a microprocessor 160 (FIG. 9), as discussed in greater detail below.

FIGS. 7 and 8 illustrate the location and angular orientation of the IR transmitters 122 within the throat assembly 50. The transmitters 122 are mounted within the housing 130 adjacent the forward (front) wall of the dispensing throat 24 and are oriented (angled) towards the rear of the dispenser at an angle of 15° with respect to vertical. The transmitters 122 have a relatively narrow transmission cone of 40° (20° on each side of the axis A of the transmitter). The angular orientation and transmission cone are designed such that the effective detection zone between the 0% intensity lines D1 and D2 does not extend forward of planes B or C up to the maximum effective range (sensitivity) of the transmitters. The plane B corresponds to the vertical plane of the innermost (towards the back) component of the front cover 22 of the dispenser, and the plane C corresponds to the vertical plane of the front cover 22 presented to the user (see page 13). Plane E in FIG. 8 is a vertical plane corresponding to the forward most portion of the cover 22. With this configuration, a user must purposefully place their hand or other object below the housing 16 and towards the back of the housing 16 in order to be "detected" and initiate a dispensing cycle.

Referring to FIG. 7, additional shielding structure 136 may be provided, for example by structure defining the housing 130 or frame 42 of the throat assembly 50, so as to further limit the forward portion of the transmission cone of the transmitters 122. For example, the shielding 136 may eliminate at least 5° of the forward portion of the transmission cone. In other words, the forward portion of the transmission cone will be no greater than 150 relative to the axis A of the transmitter. This reduced cone portion is represented by the line D3 in FIG. 7. This additional shielding ensures that, even at maximum power (maximum sensitivity) of the transmitters 122, the detection zone does not "break" (i.e., extend forward of) planes C or B.

It may also be desirable to provide the dispenser 10 with the capability to prevent a subsequent dispensing cycle if a sheet of material has been dispensed but not removed. A separate "hanging sheet" detector may be provided and integrated with the control circuitry for this purpose. However, in the illustrated embodiment, the IR detection sensor configuration also serves this purpose. Referring to FIG. 7, a hanging sheet of material is represented by the line 200. This sheet 200 is at a position such that it essentially blocks transmission of the active IR signal from the transmitters 122 into the detection zone 134. The web material itself does not adequately reflect the IR signal to the receiver 124, and the hanging sheet does not generate a valid detection signal. Thus, an object placed into the detection zone 134 while a sheet 200 is left hanging from the dispensing throat 24 is not likely to cause a subsequent dispensing cycle until the hanging sheet has been removed, or is purposefully pushed out of the detection zone 134.

Figure 9:
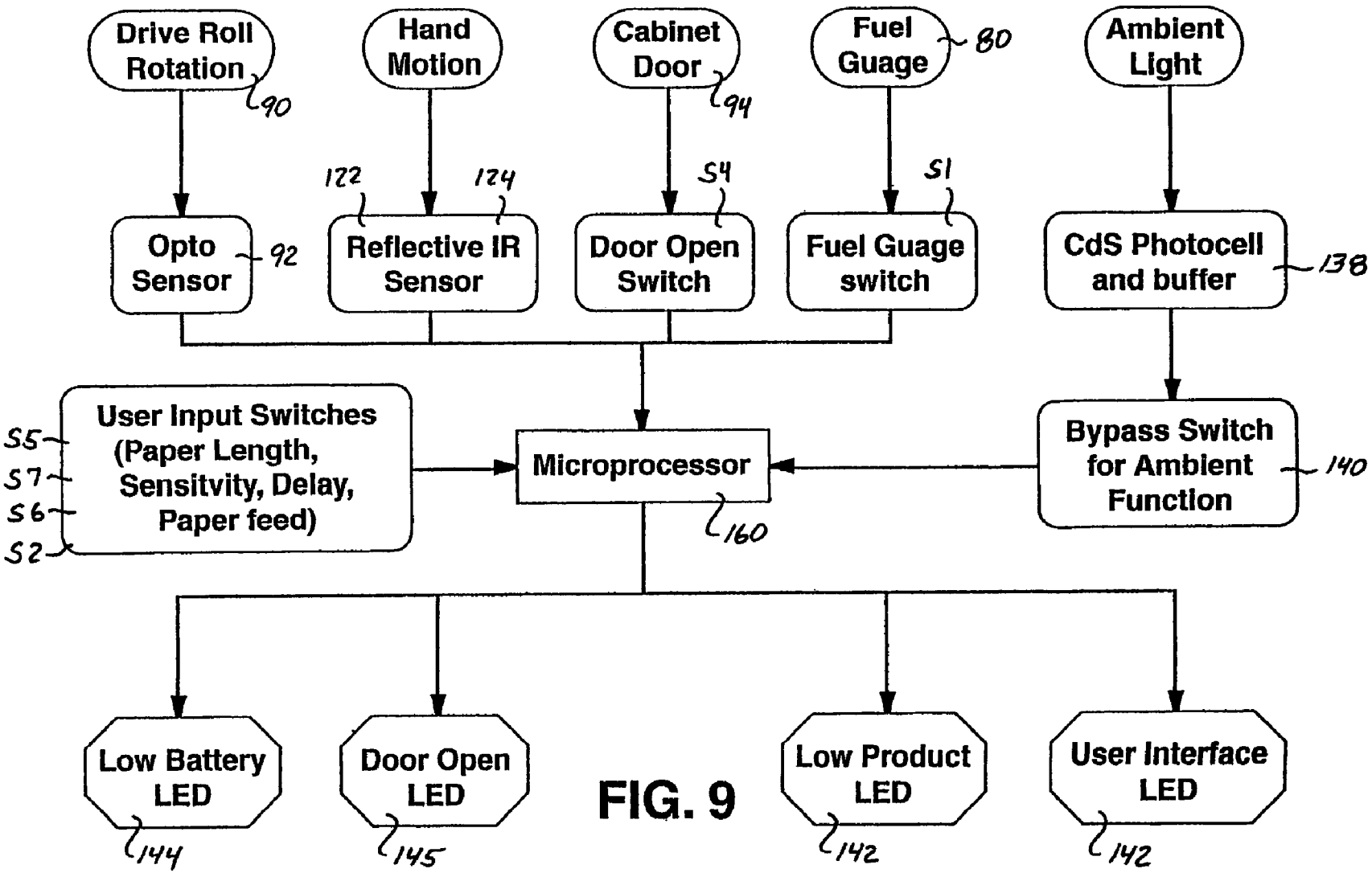
FIG. 9 is a block diagram illustrating an embodiment of aspects of control circuitry that may be used with the dispenser according to the invention.

It may also be desired to provide the dispenser 10 with an ambient light detector integrated with the control circuitry to prevent a dispensing cycle unless a threshold amount of ambient light is detected in an area where the dispenser 10 is located. The illustrated embodiment includes such a detector. Referring to FIGS. 2 through 4, a forward looking ambient light photo sensor 138, such as a conventional photocell, is mounted on the circuit board 110 and "looks" out through an opening in the forward edge of the circuit housing 108. Referring to FIG. 9, the photo sensor 138 is integrated with the control circuitry such that the circuitry is activated so long as a threshold amount of ambient light is detected by the photo sensor 138. It certain situations, the ambient light detector function may not be desired. For this reason, a bypass switch 140 may be provided and accessible externally of the circuit housing 108 such that maintenance personnel may bypass and deactivate the ambient light sensing feature. In the illustrated embodiment, the switch 140 is accessible through the circuit housing cover below the push buttons 148, 150, 152 upon opening the dispenser cover 22.

In a normal operating condition of the dispenser 10, the ambient light detector 138 is shielded in the forward direction by the dispenser cover 22. Thus, the detector "sees" the ambient light filtering in through openings in the cover 22, such as through the dispensing throat 24 and opening 26 in the side of the cover 22. With this arrangement, the detector is less sensitive to fluctuations in ambient light occurring in front of the dispenser that may be caused by normal activity in a public restroom or other facility.

FIG. 9 is a functional block diagram of an embodiment of control circuitry that may be used with the dispenser 10. It should be appreciated that various control circuits and component arrays may be configured by those skilled in the art to accomplish the desired features of the dispenser 10, and that the circuit described herein is but one embodiment of suitable circuitry. Referring to FIG. 9, the circuit is controlled by a microprocessor 160. The various inputs and outputs for the microprocessor 160 indicated in FIG. 9 have been discussed above. Certain of the switches indicated in the figure are presented in more detail in the schematic drawings of FIGS. 10A through 10G. The control functions of the microprocessor 160 are discussed further below with reference to the schematic drawings.

The circuitry consists of two circuit boards (main control board 110 and sensor board 126), battery compartment 82, and DC motor 100. The main control board 110 consists of the following functional sections: Battery power supply; AC power supply; Relay and motor protection; Ambient light detector; Proximity sensor; Oscillator and microprocessor; and Switches and LED indicators. The respective sections are discussed below through reference to FIGS. 10A through 10G. It should be appreciated that the values listed in FIGS. 10A through 10G are presented for illustrative purposes only, and that the control circuitry is in no way limited by any particular component configuration or values. Those skilled in the art are capable of devising various control circuits suitable for use with a dispenser according to the present invention.

Figure 10A:
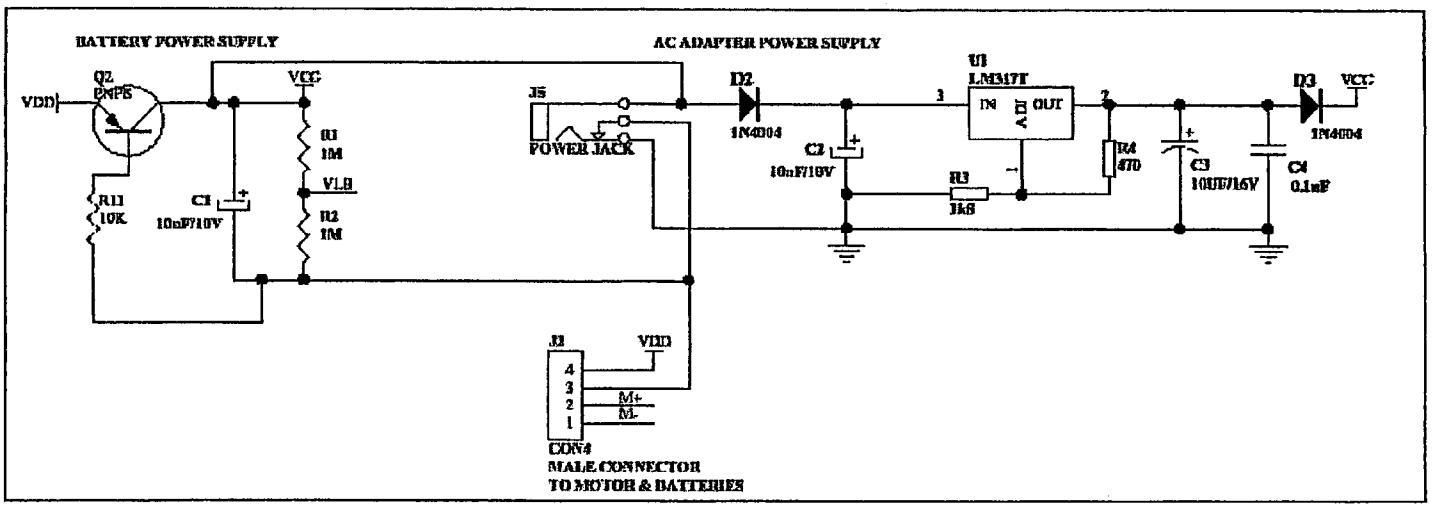
FIGS. 10A through 10G are block circuit diagrams for particular components of an exemplary control circuit that may be used with the dispenser according to the invention.

The battery and AC power supply circuit is shown in FIG. 10A. DC power is supplied by the batteries in the battery compartment 82 and the DC circuitry generates a Vcc of about 5.3 volts. A low battery voltage condition is detected by the microprocessor, which results in activation of the low power LED LD4 (FIG. 10G). The AC power supply section consists of a power jack 109 that is supplied with an external (via an AC source and transformer) supply of between about 7.5V to about 9.0V (1 Amp) supply to the circuitry labeled "AC Adapter Power Supply" in FIG. 10A. The circuitry includes stabilizing circuitry, such as the LM317 stabilizer and passive components, to generate the voltage Vcc. The power jack includes a switch that disconnects the DC power supply upon connecting the external source to the power jack.

Figure 10B:
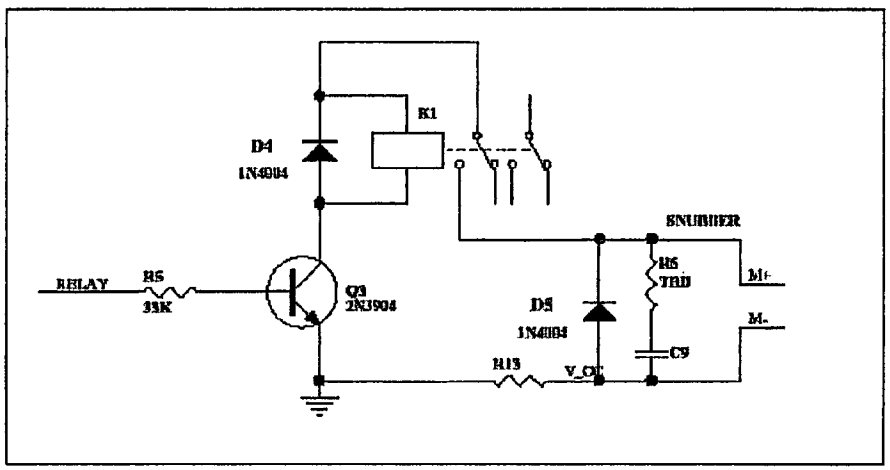

The Relay and Motor Protection circuitry is shown in FIG. 10B. A 5V relay is used to turn the motor on and off. Over current protection components are included to protect the motor from any number of over current conditions, and include the current sensing resistor R13 operating in conjunction with an A/D converter in the microprocessor. A voltage generated by current through the resistor R13 is converted to a digital value by the A/D converter and compared to a set point value to determine if an overcurrent condition exists in the supply to the motor. If an overcurrent condition exists, the relay is opened and current supply to the motor is terminated.

Figure 10C:
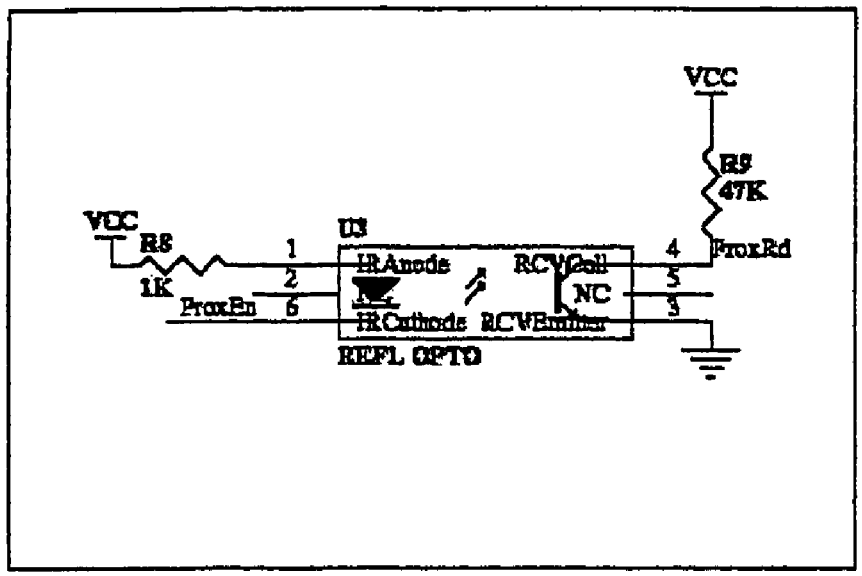
Figure 10D:
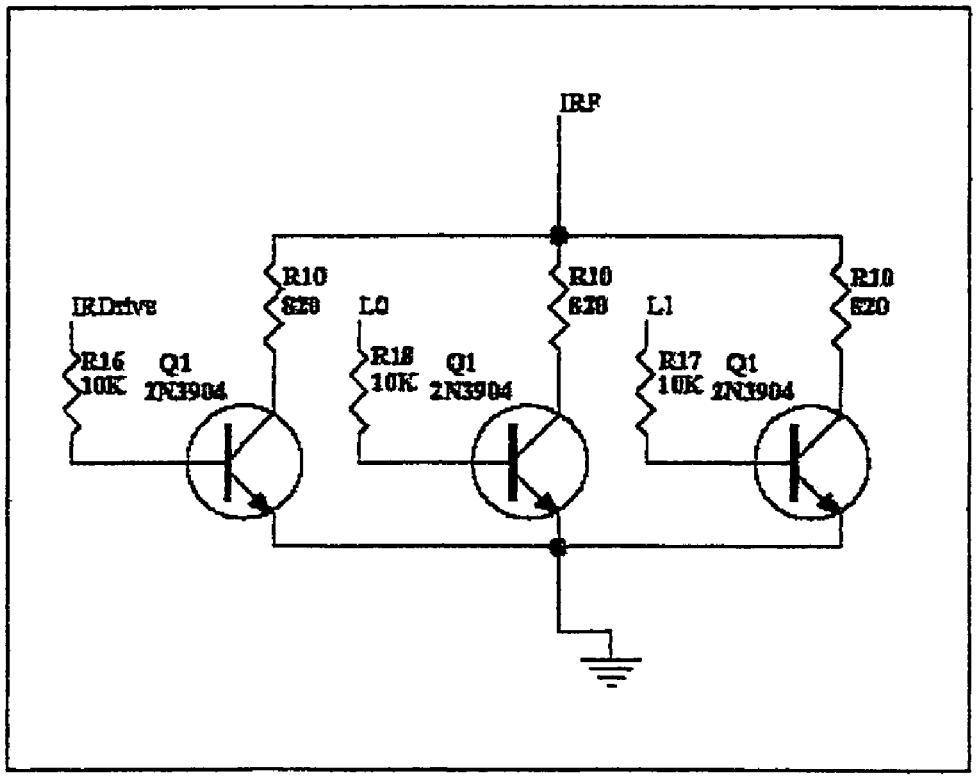

FIG. 10C is a schematic of the optical encoder sensor U3 used to count revolutions of the drive roll 38. The count is used by the microprocessor 160 to determine how long power is supplied to the motor 100 for dispensing a sheet of desired length. Once the measured length of web material has been dispensed, the motor 100 is turned off. The desired sheet length may be adjusted by a maintenance technician by way of the switch S5 and the LED LD 3 (FIG. 10G).

As discussed, a low paper condition of the main roll 12 is sensed by the mechanical arm 80 and, at a certain diameter of the main roll 12, the arm 80 triggers switch S1 (FIG. 10G) causing a low paper indication by way of the LED LD3 (FIG. 10G). Paper may be manually advance by pressing the switch S2.

The switch S4 in FIG. 10G is configured with the cover sensor 94 discussed above and prevents the circuitry from operating as long as the cover 22 is in an open condition.

A delay time feature may also be provided with the circuitry to prevent a subsequent dispense cycle until a defined time period has expired from the last dispense cycle. For example, it may be desired that a delay time of about 1 second between dispense cycles is programmed into the microprocessor. This delay time may be changed by a maintenance technician by way of switch S6 and LED LD 3 (FIG. 10G).

Figure 10E:
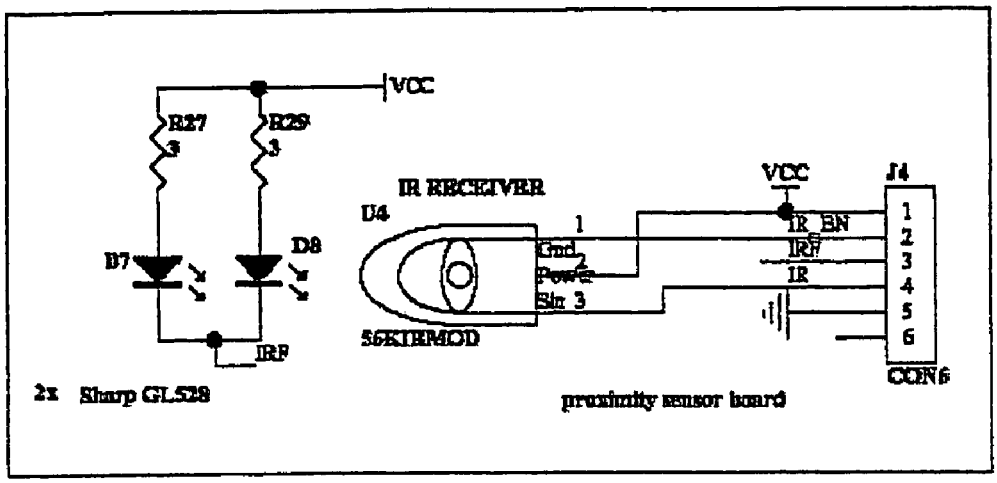

FIG. 10E is a schematic of the sensor board 126 and illustrates the IR transmitters D7 and D8 pulsed at a frequency determined by the clock and microprocessor circuitry. The IR receiver U4 looks for reflected IR energy in the same pattern as the transmitted signal, and if received, the motor 100 is activated via relay K1 (FIG. 10B). In the illustrated embodiment, the receiver is a monolithic IR receiver operating at 56 kHz. The receiver detects the presence of reflected 56 kHz signal from an object in the detection zone of the transmitters. The sensitivity (i.e., range) of the transmitters D7 and D8 may be changed by a maintenance technician by way of switch S7 and LED LD3 (FIG. 10B). FIG. 10D is a schematic of the current regulation circuitry is used to set the three different detection levels (high, medium, and low).

Figure 10F:
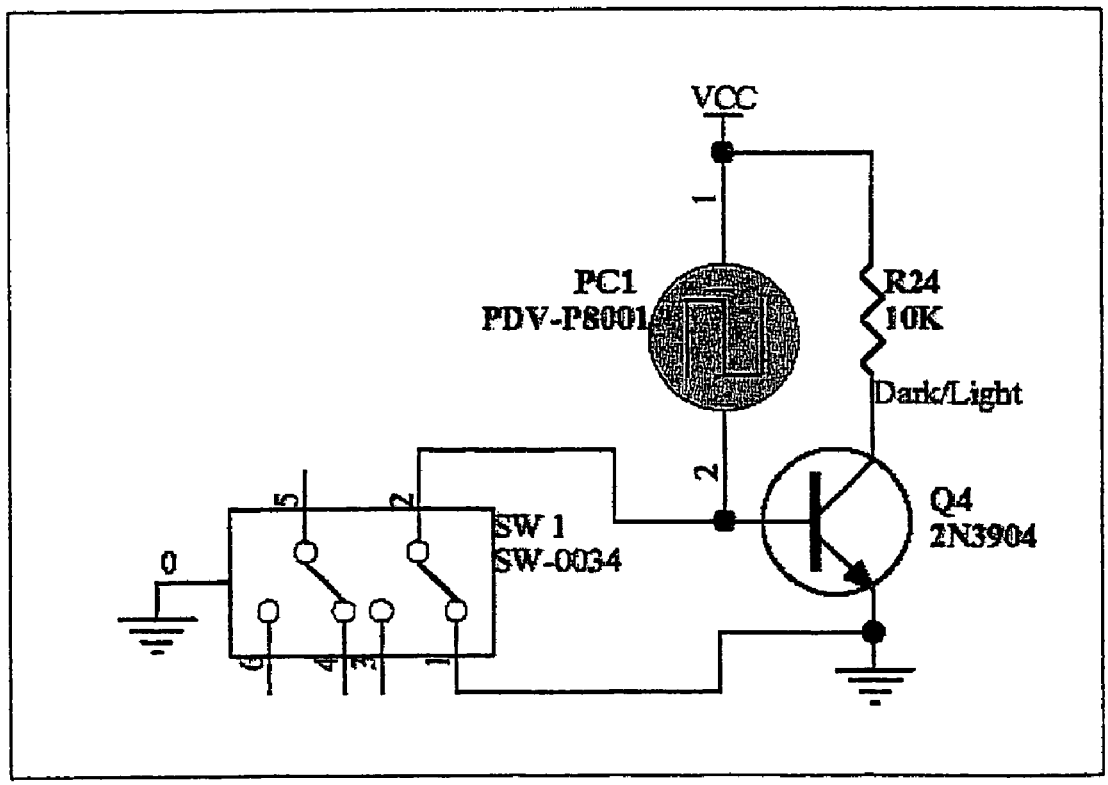
Figure 10G:
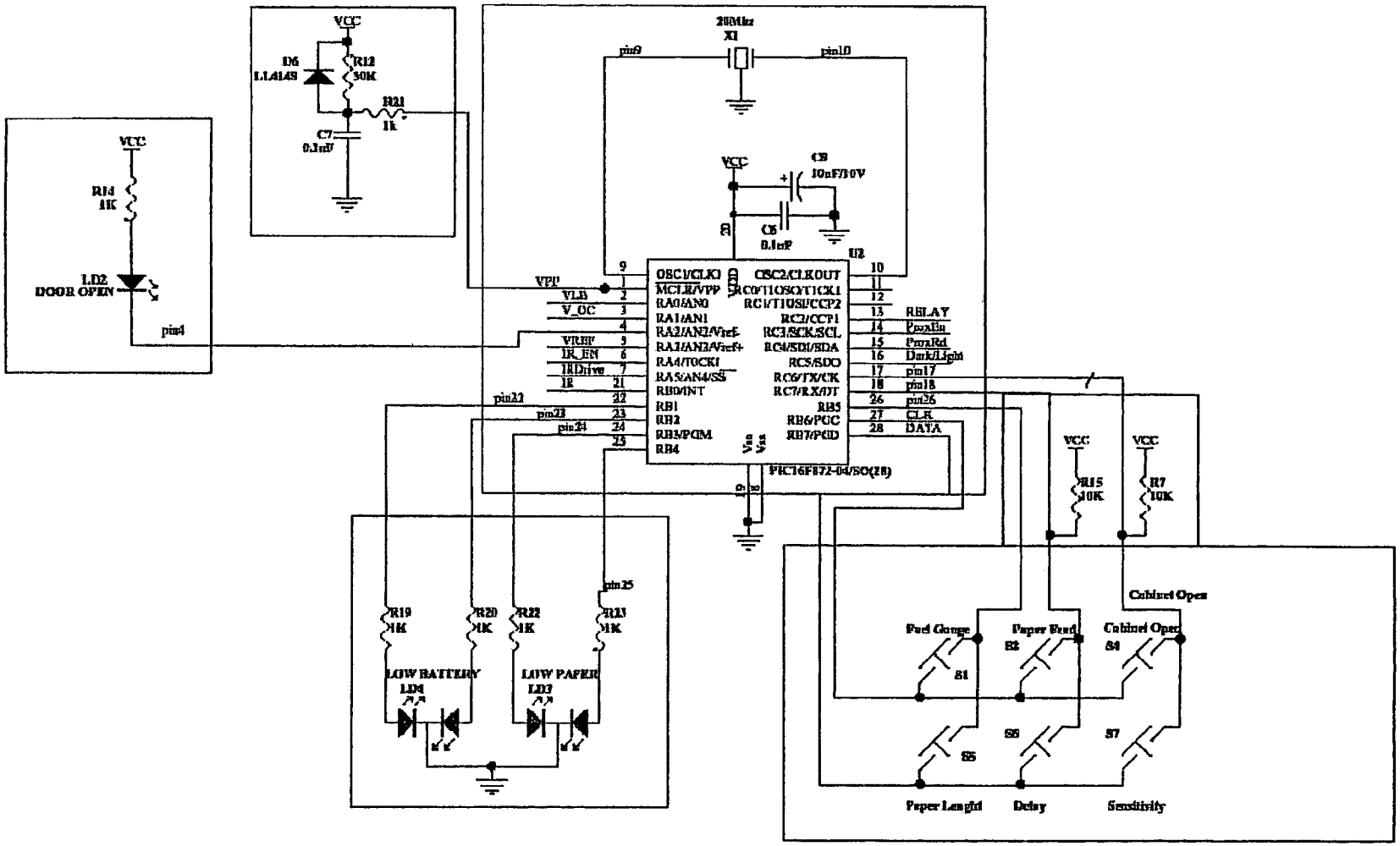

FIG. 10F is a schematic of the ambient light sensor wherein a photocell PC1 is used to detect ambient light. If sufficient light is detected, a corresponding signal is sent to the microprocessor and the circuitry remains energized. If ambient light is below the threshold detection level of the photocell PC1, circuitry is de-energized. The ambient light detection feature may be bypassed with the switch SW1.

FIG. 10G is a schematic of the Oscillator and Microprocessor section, as well as the LED indicators discussed above. A NAND based RC oscillator is used as the main clock for the microprocessor and the proximity sensor circuitry. The oscillator generates a frequency signal that may be used directly by the microprocessor, or reduced to a lower clock frequency for the main controller (i.e., a Flash Microchip PIC 16F872 microcontroller), proximity sensors and circuitry of FIG. 10E. In the illustrated embodiment, the clock frequency is relatively high at 20 MHz. If the controller is to be "on" at all times and powered by battery power, it may not be desired to run the controller at such a frequency due to battery consumption concerns. A binary frequency divider circuit may be utilized to step down the operating frequency to a lower desired operating frequency, for example about 156 KHz or lower. The operating frequency may be designed based on various considerations, such as maximizing battery life, necessary operating frequency for the detection circuitry, availability of AC power, and so forth. A low continuous operating frequency may significantly reduce battery consumption to an acceptable level.

In an alternate embodiment, the microprocessor may operate at two different operating frequencies under software control. These frequencies may be determined by the frequency divider as binary fractions of the oscillator clock speed. For example, the microprocessor may operate at a continuous relatively low frequency. However, when an IR pulse needs to be sent, the operating speed is accelerated under software control to allow for signal processing and triggering of the motor and timing circuits. Thus, the operating speeds would vary as a function of a desired IR pulse frequency for the proximity sensors D7 and D8.

It should be appreciated by those skilled in the art that various modifications and variations may be made to features of the dispenser described herein, particularly to the mechanical and control circuitry aspects of the dispenser, without departing from the scope and spirit of the invention. It is intended that the invention include all such variations.

What is claimed is:

1. A hands-free towel dispenser for dispensing a measured sheet from a roll of web material, comprising:

a housing having an internal volume so as to retain at least one roll of towel material therein;

an electronically powered dispensing mechanism contained within said housing for dispensing a measured sheet from the roll of web material upon actuation of said dispensing mechanism;

a sensor contained within said housing to detect an object placed within a detection zone of said sensor;

control circuitry configured with said sensor and said dispensing mechanism to initiate a dispense cycle upon detection of an object by said sensor;

said sensor disposed relative to said housing such that said detection zone is defined substantially below a bottom surface of said housing such that an object must be placed at a location below said housing to be detected by said sensor;

wherein said sensor comprises at least one active transmitter and a receiver, said transmitter disposed within said housing and oriented to transmit an active signal defining said detection zone below said housing; and wherein said sensor comprises a combination of two IR transmitters disposed on opposite sides of an IR sensor.

2. A hands-free towel dispenser for dispensing a measured sheet from a roll of web material, comprising:

a housing having an internal volume so as to retain at least one roll of towel material therein;

an electronically powered dispensing mechanism contained within said housing for dispensing a measured sheet from the roll of web material upon actuation of said dispensing mechanism;

a sensor contained within said housing to detect an object placed within a detection zone of said sensor;

control circuitry configured with said sensor and said dispensing mechanism to initiate a dispense cycle upon detection of an object by said sensor;

said sensor disposed relative to said housing such that said detection zone is defined substantially below a bottom surface of said housing such that an object must be placed at a location below said housing to be detected by said sensor;

wherein said sensor comprises at least one active transmitter and a receiver, said transmitter disposed within said housing and oriented to transmit an active signal defining said detection zone below said housing; and wherein said active transmitter is disposed at an angle within said housing such that a sensing axis of said active signal is angled towards a back of said housing.

3. The dispenser as in claim 2, wherein said sensing axis is at an angle of about 15 degrees with respect to vertical.

4. The dispenser as in claim 2, wherein said active transmitter has a transmission cone of about 40 degrees.

5. The dispenser as in claim 2, wherein said sensing axis is at an angle of about 15 degrees with respect to vertical, and said active transmitter has a transmission cone of about 20 degrees on each side of said sensing axis.

6. The dispenser as in claim 5, wherein a forward portion of said transmission cone does not extend in a forward direction beyond a vertical plane of a forward most portion of said housing.

7. The dispenser as in claim 6, wherein said active transmitter comprises an adjustable intensity setting, and at a maximum intensity setting and range, said transmission cone does not extend to said vertical plane.

8. The dispenser as in claim 2, wherein said active transmitter has a transmission cone that does not extend in a forward direction beyond a vertical plane of a forward most portion of said housing.

9. The dispenser as in claim 8, wherein said active transmitter is shielded in a forward direction such that a forward portion of said transmission cone is reduced as compared to a rearward portion of said transmission cone.

10. The dispenser as in claim 9, wherein said active transmitter comprises an adjustable intensity setting, and at a maximum intensity setting and range, said transmission cone does not extend to said vertical plane.

11. A hands-free towel dispenser for dispensing a measured sheet from a roll of web material, comprising:

a housing having an internal volume so as to retain at least one roll of towel material therein;

an electronically powered dispensing mechanism contained within said housing for dispensing a measured sheet from the roll of web material upon actuation of said dispensing mechanism;

a sensor contained within said housing to detect an object placed within a detection zone of said sensor;

control circuitry configured with said sensor and said dispensing mechanism to initiate a dispense cycle upon detection of an object by said sensor;

said sensor disposed relative to said housing such that said detection zone is defined substantially below a bottom surface of said housing such that an object must be placed at a location below said housing to be detected by said sensor;

wherein said housing comprises a dispensing throat in a bottom portion thereof through which the web material is dispensed, said sensor comprising at least one active transmitter and a receiver oriented within said housing adjacent to said dispensing throat to transmit an active signal in a transmission zone defining said detection zone below said housing; and wherein said active transmitter and receiver are oriented with respect to said dispensing throat such that a sheet of the towel material hanging out of said dispensing throat disrupts detection of an object within said detection zone.

12. A hands-free towel dispenser for dispensing a measured sheet from a roll of web material, comprising:

a housing having an internal volume so as to retain at least one roll of towel material therein;

an electronically powered dispensing mechanism contained within said housing for dispensing a measured sheet from the roll of web material upon actuation of said dispensing mechanism;

a sensor contained within said housing to detect an object placed within a detection zone of said sensor;

control circuitry configured with said sensor and said dispensing mechanism to initiate a dispense cycle upon detection of an object by said sensor;

said sensor disposed relative to said housing such that said detection zone is defined substantially below a bottom surface of said housing such that an object must be placed at a location below said housing to be detected by said sensor;

an ambient light detector, said ambient light detector configured with said control circuitry to allow a dispense cycle only upon detection of a threshold amount of ambient light in an area where said dispenser is located; and further comprising a manually actuated bypass to said ambient light detector so that said dispenser is configurable to operate regardless of ambient light level.

13. A method of operation for an electronic hands-free paper towel dispenser, comprising defining a detection zone of an object sensor substantially entirely below a bottom portion of the dispenser housing and rearward of a front portion of the housing such that a user is required to place their hand or other object below and towards a back of the dispenser housing to initiate a automatic hands-free dispense cycle, said method further comprising defining the detection zone with an active transmitter and initiating a dispense cycle upon a receiver receiving a threshold amount of reflected active signal from an object placed in the detection zone, and further comprising directing the active signal below and at an angle towards the back of the dispenser housing such that a transmission cone of the active signal does not extend forward of a vertical plane of a forward most component of the dispenser housing.

14. The method as in claim 13, wherein the transmission cone is about 40 degrees.

15. The method as in claim 14, further comprising shielding a forward portion of said transmission cone.

* * * * *